United States Patent [19]

Ferguson

[11] Patent Number: 4,624,203

[45] Date of Patent: Nov. 25, 1986

[54] BATTEN STRUCTURE FOR A WING SAIL

[76] Inventor: R. Stirling Ferguson, P.O. Box 462, Arnprior, Ontario, Canada, K7S 3L9

[21] Appl. No.: 715,556

[22] Filed: Mar. 25, 1985

[30] Foreign Application Priority Data

Apr. 19, 1984 [CA] Canada ..... 452409

[51] Int. Cl.[4] ..... B63H 9/06

[52] U.S. Cl. ..... 114/39; 114/102; 244/219

[58] Field of Search ..... 114/102, 103, 39, 104, 114/97, 98; 244/219

[56] References Cited

U.S. PATENT DOCUMENTS

| | | | |
|---|---|---|---|
| 66,633 | 7/1864 | Robbins | 114/98 |
| 4,074,646 | 2/1978 | Dorfman et al. | 114/140 |
| 4,341,176 | 7/1982 | Orrison | 244/219 |
| 4,386,574 | 6/1983 | Riolland | 114/103 |

FOREIGN PATENT DOCUMENTS

| | | | |
|---|---|---|---|
| 789916 | 7/1968 | Canada . | |
| 527205 | 10/1921 | France | 244/219 |
| 568209 | 3/1945 | United Kingdom | 114/103 |
| 623036 | 5/1949 | United Kingdom | 114/102 |

OTHER PUBLICATIONS

"Wing Sails" (AYRS Publn. No. 14 of Aug. 1957 pp. 10, 14, 16 and 17.

"Sail" Magazine Dec. 1978 pp. 45–50 (p. 49 shows wing sail).

*Primary Examiner*—Galen Barefoot

*Assistant Examiner*—Thomas J. Brahan

*Attorney, Agent, or Firm*—Beveridge, DeGrandi and Weilacher

[57] ABSTRACT

The invention provides a batten structure which can be placed inside a double sided sail to provide a so-called "wing" sail having an airfoil section which can be close to an ideal airfoil on either tack. The structure includes a central beam which engages the mast, a nose piece pivotably connected to the front end of the beam, and two flexible batten members each extending rearwardly from rigid connections on opposite sides of the nose piece and being slidably connected together at their rear ends. Spreaders which are movable relative to the beam connect the batten members and maintain its airfoil shape while allowing the batten members to flex when the wind moves from one side of the sail to the other.

14 Claims, 9 Drawing Figures

BATTEN STRUCTURE FOR A WING SAIL

Figure 1:
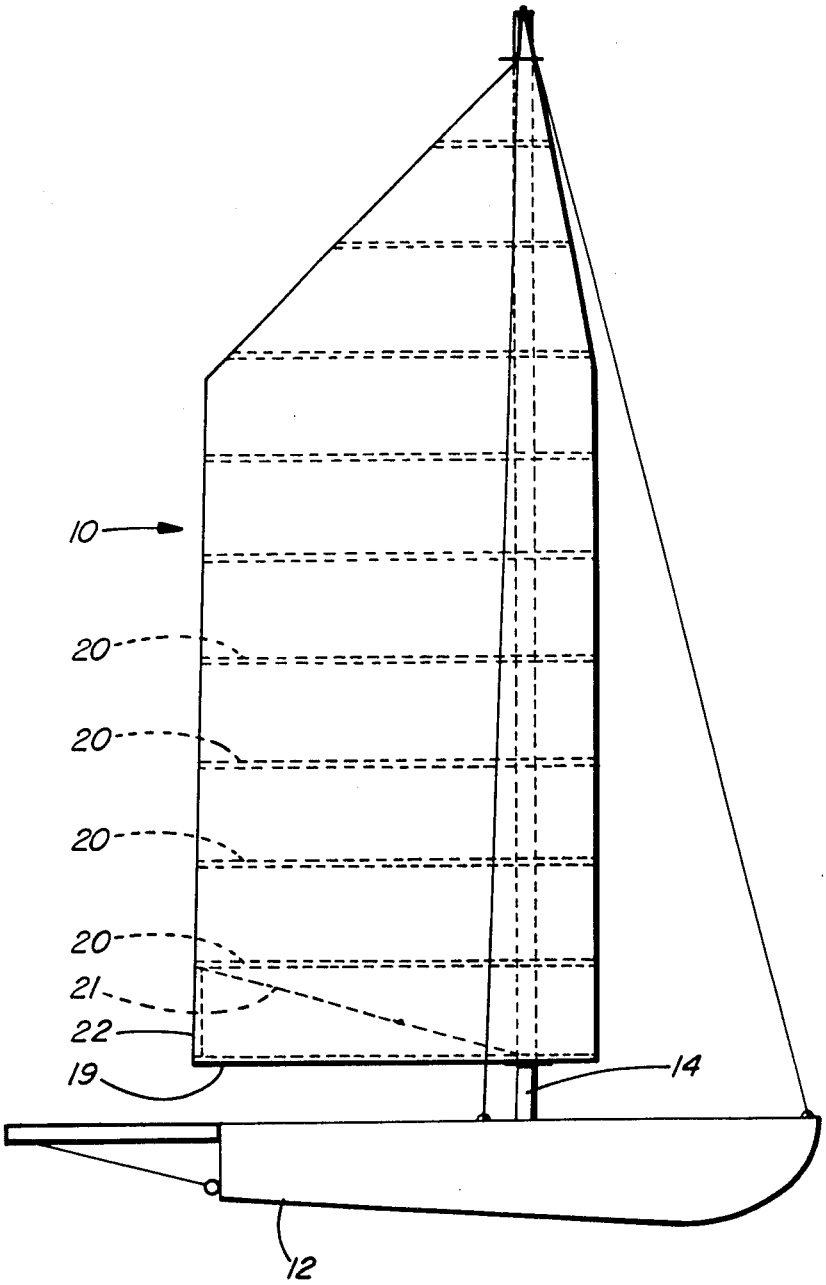

The present invention relates to a batten structure which can be used in a double sided wing sail to provide the sail with an airfoil shape.

So-called "wing sails" have been used in the past to improve the performance of sailing craft. While most of the use has been experimental, wing sails have been used in sailing races, especially in catamaran racing. Most wing sails have not achieved the ideal airfoil sections which have been developed for aircraft, due to difficulties in making such a structure which must be lightweight and which should be capable of reversing the camber depending upon the tack of the boat. Commonly, the sectional shape of wing sails which have been used is either completely symmetrical or has a symmetrical front portion with a movable flap portion, for example as described in U.S. Pat. No. 2,484,687 to Carl, issued Oct. 11, 1949. Other patents showing double sided wing sails are U.S. Pat. Nos. 2,077,685 to Gerhardt, issued Apr. 20, 1937, 2,569,318 to Kersten, issued Sept. 25, 1951, 3,371,636 to Sharp, issued Mar. 5, 1968, 3,580,203 to Martin, issued May 25, 1971, 3,598,075 to Kenney, issued Feb. 13, 1970, 4,064,821 to Roberts, issued Dec. 27, 1977.

In this connection, U.S. Pat. No. 4,074,646 to Dorfman is also of interest in showing a variable foil keel for a sailboat.

None of the above listed patents provides a sail or batten structure which produces an ideal smooth airfoil shape. While the batten structure shapes shown in U.S. Pat. Nos. 2,569,318 and 4,064,821 come fairly close to proper airfoils, they have discontinuities at the leading edges and, in the latter case, at the trailing edge which would interfere with a smooth wind flow. U.S. Pat. No. 3,598,075 shows an airfoil shape which appears fairly close to the ideal, but since this shape depends on the air pressure distribution over the sail surface it is questionable if the ideal shape is readily achieved in practice. A further drawback of the structures shown in these three patents, as with conventional sails, is that there is no positive control of the degree of twist in the sail which is likely to be greater than what would be ideal.

My invention provides a batten structure for use in combination with similar batten structures held in spaced apart relation inside a hollow, double sided sail to provide an airfoil section which can be close to the ideal on either tack. While the batten structure may be such that the camber reverses automatically when the wind moves from one side of the sail to the other, the shape of the sail surfaces are not entirely determined by the wind pressure; if the wind pressure is sufficient the shape is determined by the features of the batten structure and can be selected to conform with aerodynamic requirements. Unlike in some of the patented designs referred to previously, the airfoil shape is independent of the shape of the mast.

Another advantage of my batten structure over most previous designs is that the mast can be arranged to be fairly near (preferably just in front of) the centre of pressure of the sail for typical sailing conditions. This is especially desirable when using a rotatable mast in which the mast itself is rotated to set the sail, rather than the sail being set by the conventional boom and main sheet arrangement. Rotatable masts for this purpose are known per se, for example from the aforesaid U.S. Pat. No. 2,077,685, but in that prior patent the mast forms the luff of the sail so that considerble torque is imposed on the mast and the rotating mechanism during sailing.

The batten structure of my invention comprises:

a beam having means for engaging a support such as a mast, a nose piece pivotably connected to the front end of said beam, two flexible batten members each extending rearwardly from opposite sides of the nose piece outside of said beam and having rear ends slidably connected together rearwardly of the rear end of the beam, and spreader means connecting said batten members together and movable relative to said beam, the arrangement of said spreader means, beam, nose piece and batten members being such that one of the batten members can be flexed towards the beam and into a shape determined by direct or indirect contact with the beam while the other batten member is held in convex shape by the spreader means, the said shapes of the batten members together with the nose piece forming a cambered airfoil section.

The beam may directly contact the batten member on the pressure side, and may be flat on both sides or slightly concave depending on the desired airfoil shape. Alternatively, the beam may contact the batten members only indirectly, as for example where spacers are used between the beam and the batten members. In the latter case a simple parallel sided beam may be used to produce a concave profile on the windward side. The spacers may be replaceable to allow the shape of the airfoil section to be changed without changing the shape of the beam; conveniently the spacers may be made slidable on rods forming the spreader means.

Preferably, the beam has a non-circular aperture for engaging a non-circular mast in a slidable manner but with limited rotation. This allows the sail to be raised in a conventional manner with the batten structures attached to the sail at spaced intervals, these sliding up the mast as the sail is raised. The limited rotation of the beam on the mast determines the degree of twist in the sail.

The batten members preferably provide a smooth continuation of the surface of the nose piece, and are slidably connected together at their rear ends so that the rear edge of the sail provides a relatively smooth sharp edge.

Figure 2:
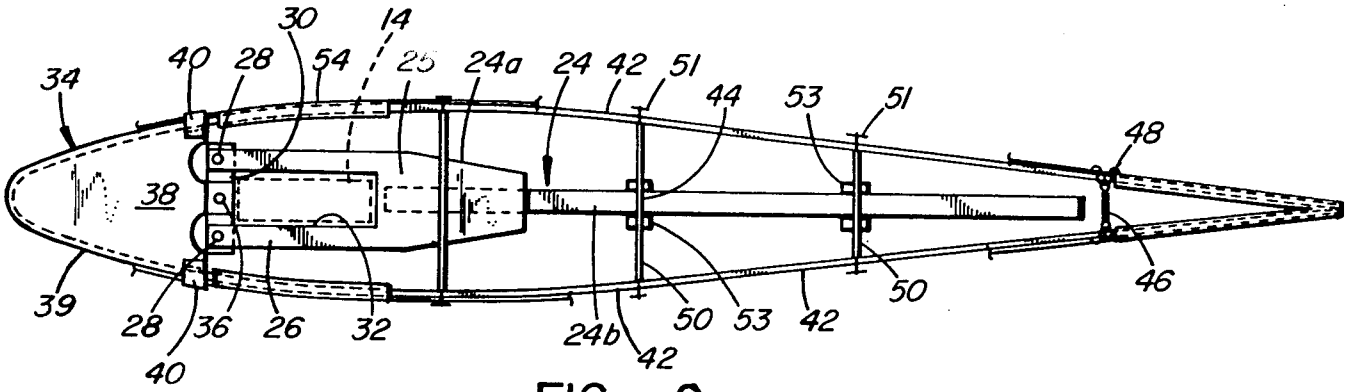
Figure 3:
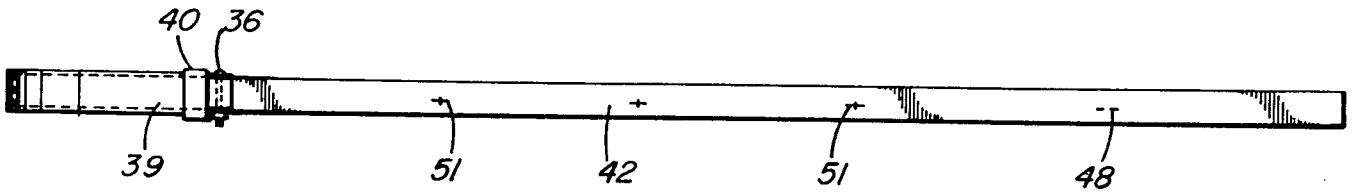
Figure 4:
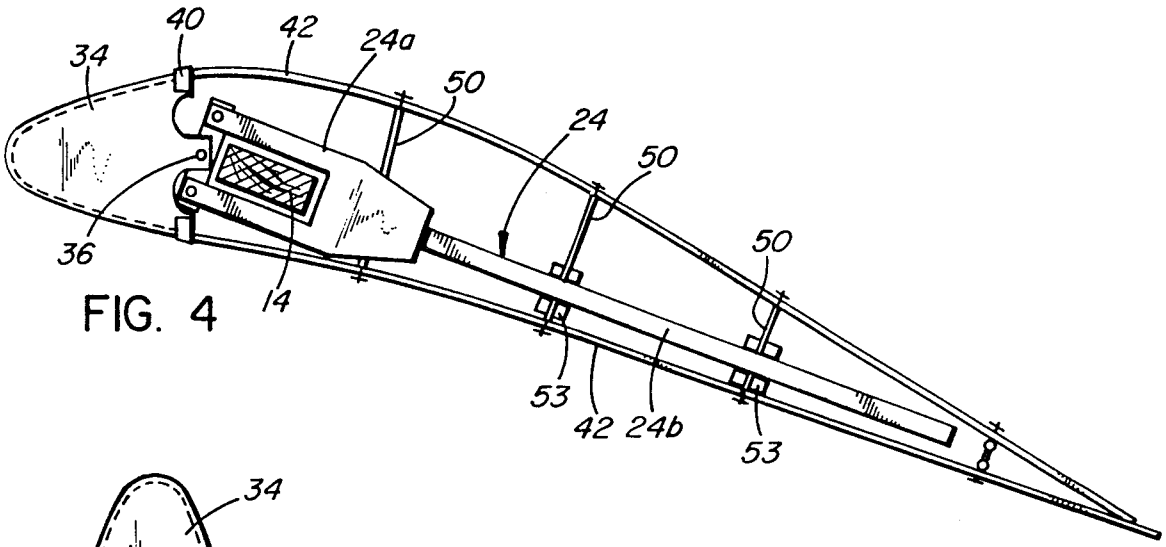
Figure 5:
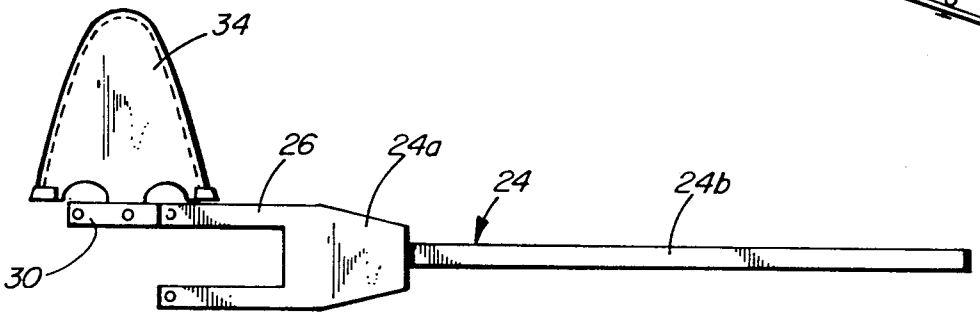
Figure 6:
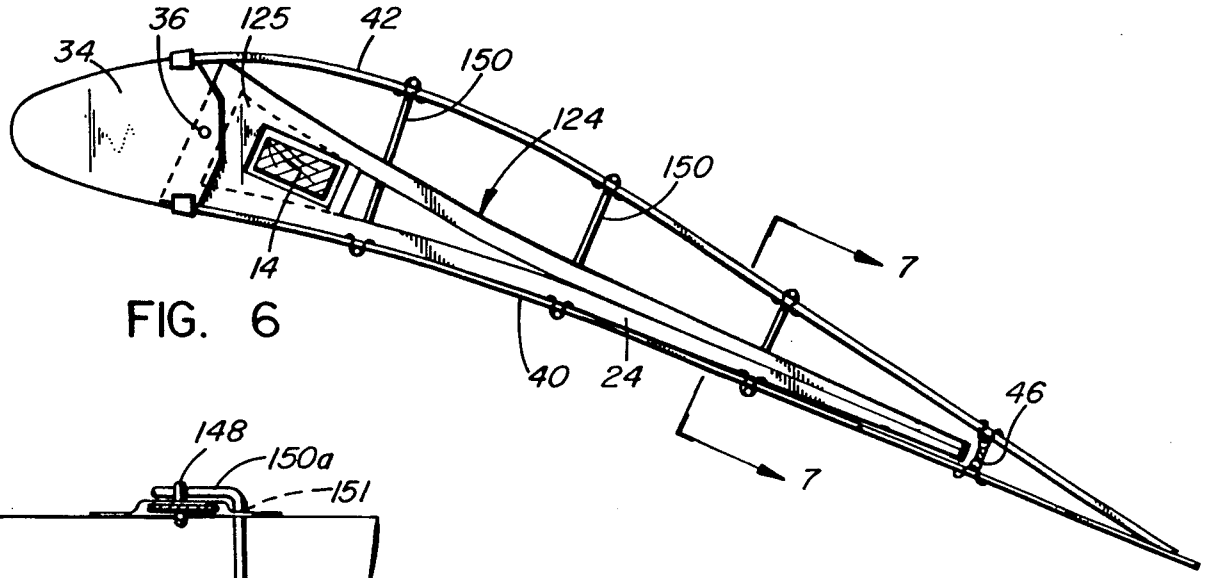
Figure 7:
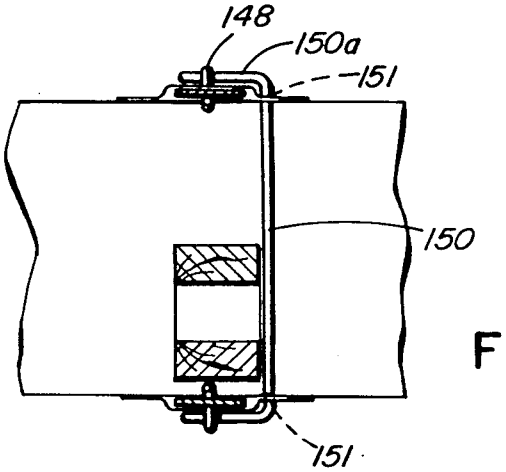
Figure 8:
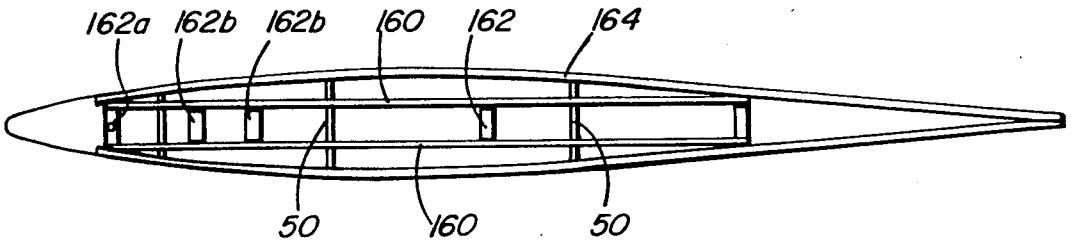
Figure 9:
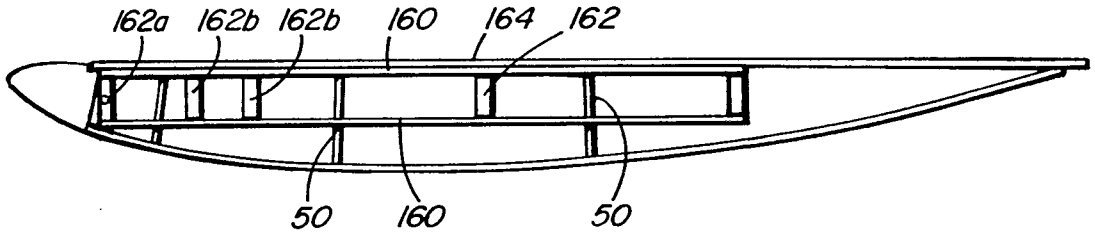

The invention will now be described in detail with reference to the accompanyng drawings which show preferred embodiments thereof, and in which:

FIG. 1 shows an elevation of a sailing boat having a wing sail of the type which can incorporate the batten structures of this invention, FIG. 2 shows a plan view of a preferred form of batten structure in accordance with the invention, as incorporated in a double sided wing sail, FIG. 3 shows a side view of the batten structure of FIG. 2, FIG. 4 shows, on a smaller scale, the same batten structure when incorporated in a wing sail which is subjected to wind pressure on one side, FIG. 5 shows diagrammatically, how the front portion of the batten structure can be opened for fitting onto a mast, FIG. 6 is a view similar to FIG. 4 of a modified batten structure with associated sail parts, FIG. 7 is an enlarged cross-sectional view taken on lines 7—7 of FIG. 6; and FIGS. 8 and 9 show plan views of a simplified batten structure in two conditions.

FIG. 1 shows a dinghy having a single wing sail 10. The hull 12 of the dinghy, which of course is not in any way a part of the invention, may be conventional. The mast 14 is of rectangular form having its largest dimension fore and aft, and is designed to be rotatable within the hull to set the sail, so that the conventional main sheet is not required. Again, the means for rotating the mast are not part of the present invention, but such means are known in the art for example from the aforesaid U.S. Pat. Nos. 2,077,685, 2,484,687 and 3,580,203.

The mast carries a boom 19 and a series of batten structures indicated at 20 which are slidable on the mast and allow the sail to be raised in the conventional manner by pulling on a halyard which passes up the centre of the mast and over a pulley at the top. Provision may be made for reefing the sail for example by tying together the two lower-most batten structures 20. The sail is designed so that the major part of the leach of the sail is parallel to the mast and to the luff of the sail so that in the main part of the sail identical batten structures can be used. The leach of the sail is kept taut by a diagonal tension line 21 connecting the rear end of the lowermost batten structure 20 to the mast, and by a compression strut 22 connecting the rear ends of the lower-most batten structure and the boom and which is fitted after the sail is raised.

FIGS. 2, 3, 4 and 5 show the preferred batten structure for the wing sail; FIG. 2 also shows portions of a sail to show how this is attached to the batten structure and indicates the position of mast 14. The boom 19 may be similar to the batten structure except that it is of stronger construction.

The central part of the batten structure is a beam member 24 having a front portion 24*a* and a rear portion 24*b;* the latter part being a parallel-sided spar of rectangular section. The front portion 24*a* comprises two parallel plates 25 having their rear portions fixed to upper and lower sides of spar 24*b* and having bifurcated front portions 26 secured by bolts 28 to upper and lower sides of a cross-piece 30. The bifurcated portions 26, together with cross-piece 30 and the rear portions of plates 25 define a rectangular recess 32 for the mast 14; this engages the mast in a close sliding fit (as seen in FIG. 4) so that there is very little rotation between the beam and the mast.

A nose piece 34 is pivoted to the center of the cross-piece 30 by means of a vertical pivot bolt 36 as indicated in FIG. 3. The nose piece 34 is formed of upper and lower plates 38 which are shaped as the leading edge of an airfoil, having a rounded nose portion and surfaces which decrease in curvature rearwardly from the nose portion. The plates are held separated by a suitably curved, parallel sided member 39 shaped by the plates 38 to provide the front end portion of the airfoil.

The rearward end of the nose piece has straps 40 with ends fastened to the top and bottom plates 38 and with side portions which together with adjacent recesses in the sides of nose piece 34 provide pockets for the forward end portions of elongated batten members 42. These pockets provide a rigid but sliding connection between these forward end portions and the nose piece such that the forward end portions of the batten members provide continuations of the airfoil side surfaces of member 39. The forward end portions of the batten members are of reduced width so as to provide shoulders engaging the rear surfaces of the pockets. The batten members 42 are similar to conventional sail battens, the thickness variation along their length being chosen to give suitable curvatures for the airfoil shape; this generally requires that the batten members have greater flexibility towards the front than at the rear. The rear ends of the battens are free to slide relative to each other, and are held in contact by means of a tension spring 46 connected by wire retaining clips 48 to the rear end portions of the batten members. Clips 48 have central loops engaging spring 46, which are connected to outer U-shaped portions having extremities engaging in small holes in the batten members. Between their front and rear ends the batten members are held apart by a suitable number of spreader means in the form of rods 50, three rods being shown in the preferred embodiment. Each of the spreader rods is arranged to pass slidably through slots in the spar 24*b*, these slots being such as to allow fore-and-aft angular movement of the rods. The length of the spreader rods 50 is chosen so that when there is no pressure applied to either side of the batten structure this assumes a generally symmetrical airfoil section as indicated in FIG. 2.

The spreader rods 50 have pinched ends which pass through slots in the batten members and are secured thereto by pins 51. Also, the rearmost two spreader rods have freely slidable spacer sleeves 53 which limit the curvature of the batten member on the upwind side and which are readily replaceable to allow this curvature to be changed.

FIG. 2 also shows diagramatically the manner in which the wing sail is fitted over the batten structure. The sail cloth passes loosely around the front end of the nose piece, and is connected to the batten members 42 by the provision of pockets 54, on the inner sides of the two sail side portions, these pockets being similar to conventional batten pockets and extending from near the front end to the rear end of each batten member 42. The sail cloth and pockets have slots for accommodating the ends of the spreader rods 50. At the leach end means are provided for fixing the battens in the pockets. The leaches of the sail side portions are not connected together so that these do not constrain the curvature assumed by each side of the sail cloth in operation. While the batten structures as described may be mounted by being slid onto the end of a mast, it will usually be more convenient to remove one bolt 28 and to rotate the cross piece 30 and nose piece 34 as shown in FIG. 5, thus opening the mast recess and allowing the batten structure to be mounted easily in any desired location on the mast.

With this construction a series of the batten structures can be assembled on a mast, complete except for the batten members 42, these members being located in the pockets in the sail. The sail is then folded around the nose piece, the front ends of the batten members 42 are inserted in the batten pockets in the nose piece, and the ends of the spreader rods 50 are passed through the batten members and the cloth and pins 51 are passed through the ends of these rods to hold the sail in place. The sail can then be raised by attaching the conventional halyard to the head of the sail, and hauling this up the mast with the batten members sliding along the mast.

FIG. 2 shows the symmetrical shape of the batten structure when the sail is not subjected to any sideways wind pressure. FIG. 4 shows the cambered airfoil shape when there is suitable wind pressure on one side of the sail. This causes the batten member 2 on the windward side to be pressed until it conforms to the slightly concave shape shown in FIG. 4 which is determined by the size of the spacers 53. At the same time, the rigid connection between the nose piece and the batten member causes the nose piece to rotate about the bolt 36 and this, together with the action of the spreader rods 50, forces the downwind side batten member away from the beam member 24 and into a more convex shape, whereby the two batten members and nose piece together provide a cambered airfoil shape as shown in FIG. 4. The aft ends of both the batten members and of the sail cloth are free to slide relative to each other and do not interfere with this movement. The slight angular movement of the rods 50 which occurs is accommodated by the slots in the beam members 24.

It will be seen that provided that the wind pressure on the sail is sufficient to bring the windward side batten member into contact with the beam, which will depend on the flexibility of the batten members, the airfoil shape generated is entirely dependent on the shape and proportions of the beam and spacers 53, the nose piece, and the spreader rods 50, and thus can be designed to have an ideal airfoil section for any desired condition. The shape can be changed by fitting smaller or larger spacers 53, and for example these can be chosen so that the windward side of the sail is flat. It will also be noted that the airfoil shape achieved is not dependent on the shape or position of the mast and that the mast can be located near to the centre of pressure in typical sailing conditions, thus minimizing the rotational forces on the mast.

Furthermore, by suitable allowance for limited rotation between the batten members and the mast it is possible for the sail to have any desired degree of twist at whatever height this is required. This can be achieved with a tapered mast and constant shape for the beam recess. Theoretically, since wind speed increases somewhat with height above the water, a sail for sailing close hauled should twist slightly away from the wind direction with increasing height, but although a conventional sail twists generally in this way the amount of twist is usually too great and is difficult to regulate effectively.

Instead of relying on wind pressure to determine the configuration of the batten structure, the batten members may be pulled inwardly by cables leading from the part of the batten member adjacent the mast down to a control operated by the sailor. This may be desirable for sailing in light winds or to prevent inadvertent reversal of the camber of the sail.

Depending on the shape to be achieved with the sail, a sail cloth with a good degree of stretch may be desirable to avoid wrinkles. One such sail cloth is that known as "bias cut" cloth.

FIGS. 6 and 7 show a modified batten structure, in which the batten members directly contact the beam, and in which the spreader means are modified so that the structure can be assembled more easily.

In this modified arrangement the beam 124 comprises two side portions which taper from a width approximately that of the nose piece to a relatively small width at the rear end, the outer faces of the beam being slightly concave. The forward end portion of the beam has upper and lower plates 125 which provide the correct spacing of the front ends of the beam side portions and which have a rectangular aperture which is a sliding fit on mast 14. The plates 125 provide a pivot 36 for the nose piece 34 which has pockets for the front ends of batten members 42 as in the first embodiment.

The spreader rods 150 in this embodiment are designed to lie on top of beam 124, and as shown in FIG. 7 these have downwardly extending end portions **150*a* engaging the batten members. End portions 150*a* are held in place by clips 148 which are the same as clips 48 in the first embodiment, except in having outside loops designed to receive and hold the end portions 150*a* instead of holding the ends of the spring. The sails and associated parts of the batten pockets have horizontally elongated apertures 151. With this arrangement, the spreader rods can be inserted after the sail has been placed around the batten structure and after the batten members 42 have been inserted in the batten pockets of the sail and the pockets of the nose piece 34, the end portions 150*a* being turned horizontally for insertion through apertures 151, these portions then being turned down and inserted into clips 148. In this design, the shape of the windward side of the batten structure is determined by direct contact between the batten members (or associated ends of spreader rods 150) and the beam 124**.

FIGS. 8 and 9 show a simplified form of the batten structure. In this embodiment, the beam is a simple rectangle formed of longitudinal members 160 held apart by spacers 162. The foremost of these spacers **162*a* is pivoted to the nose piece which is similar to that described in the first embodiment, and which has pockets for receiving the forward ends of the batten members 164. Rearwardly of spacer 162*a* are two associated spacers 162*b* which between them and members 160 define a rectangular aperture for engaging the rectangular mast. The batten members 164 are connected together by spreader rods 50 similar to those of the first embodiment. The other features of this simplified version are similar to those of the first embodiment, and operation is generally similar except that the pressure side of the batten will always be substantially flat or convex (for example as determined by the spacers 53** described for the first embodiment) and the concave/-convex shape achieved with the first embodiment is not attainable.

Although as indicated above there are advantages in using a non-circular mast and batten structures which have only limited rotation relative to the mast, my batten structure can also be used with conventional circular masts and a conventional sheet arrangement for setting the sail. Furthermore, the batten structure could be used for a jib wing sail, in which case the apertures in the batten structure would engage the fore-stay and the wing sail would be set using the conventional jib sheet.

I claim:

1. An airfoil batten structure for use in combination with similar batten structures held in spaced apart relation within a wing sail comprising:

a beam having a front portion with aperture means for slidably engaging a support such as a mast and having a rear portion rigid with said front portion, a nose piece pivotably connected to the front end of said beam by pivot means forward of said aperture means, said nose piece having side surfaces shaped to provide the front end portion of an airfoil, two flexible elongated batten members each extending rearwardly from opposite sides of the nose piece outside of said beam, said members having front ends rigidly connected to the nose piece and providing continuations of said side surfaces and having rear ends slidably connected together rearwardly of the rear end of the beam, and elongated spreader means having opposite ends thereof connected to said batten members to link said members together and being movable relative to said beam, the arrangement of said spreader means, beam, nose piece and batten members being such that sail pressure acting on a windward one of the batten members can cause a central part of this batten member between the nose piece and the beam rear end to be flexed towards the beam and into a shape determined by direct or indirect contact with the beam causing pivoting of the nose piece towards the windward side and while the other batten member is held away from the beam and in convex shape by the spreader means and by the pivoting of the nose piece, the said shapes of the batten members together with the nose piece forming a cambered airfoil section.

2. A batten structure according to claim 1, wherein the culture means has a pivotable portion which is capable of being opened to allow insertion of the mast.

3. A batten structure according to claim 1, wherein said one batten member when flexed into said shape has its outer surface concavely curved.

4. A batten structure according to claim 1, wherein said aperture means is non-circular and is suitable for engaging a non-circular mast in slidable but substantially non-rotatable manner.

5. A batten structure according to claim 1, wherein said spreader means comprises a plurality of rods each slidable in an aperture in said beam.

6. A batten structure according to claim 1, wherein said spreader means comprises a plurality of rods slidable against a surface of the beam and having bent end end portions engageable with clips protruding from the interior surfaces of said batten members.

7. A batten structure according to claim 1, wherein said batten members provide a substantially smooth continuation of the surface of said nose piece.

8. An airfoil batten structure for use in combination with similar batten structures held in spaced apart relation within a wing sail comprising:

a beam having a front portion with aperture means for slidably engaging a support such as a mast so as to have only limited rotation relative to the mast and having a rear portion rigid with said front portion, a nose piece pivotably connected to the front end of said beam by pivot means forwards of said aperture means, said nose piece having side surfaces shaped to provide the front end portion of an airfoil, two flexible elongated batten members each extending rearwardly from opposite sides of the nose piece outside of said beam, said members having front ends rigidly connected to the nose piece and providing continuations of said side surfaces, and having rear ends connected together rearwardly of the rear end of the beam, elongated spreader means having opposite ends thereof connected to said batten members to link said members together and being movable relative to said beam, and spacer means mounted on said spreader means so as to be freely slidably thereon and readily replaceable and which limit movement of the batten members towards the beam; the arrangement of said spreader means, the spacer means, beam, nose piece and batten members being such that sail pressure acting on a windward one of the batten members can cause a central part of this batten member between the nose piece and the beam rear end to be flexed towards the beam into a shape determined by the form of the beam and the size of said spacer means, causing pivoting of the nose plate towards the windward side and while the other batten member is held away from the beam and in convex shape by the spreader means and by the pivoting of the nose piece, and the two batten members and nose piece together form a cambered airfoil section.

9. A batten structure according to claim 8, wherein said one batten member when flexed into said shape has its outer surface concavely curved.

10. A batten structure according to claim 8, wherein said aperture means is non-circular and is suitable for engaging a non-circular mast in slidable but substantially non-rotatable manner.

11. A batten structure according to claim 8, wherein said spreader means comprises a plurality of rods each slidable in an aperture in said beam.

12. A batten structure according to claim 8, wherein said spreader means comprises a plurality of rods slidable against a surface of the beam and having bent end portions engageable with clips protruding from the interior surfaces of said batten members.

13. A batten structure as claimed in claim 8, wherein said batten members provide a substantially smooth continuation of the surface of said nose piece.

14. A batten structure as claimed in claim 8, wherein the aperture means has a pivotable portion which is capable of being opened to allow insertion of the mast.

* * * * *

UNITED STATES PATENT AND TRADEMARK OFFICE

CERTIFICATE OF CORRECTION

PATENT NO. : 4,624,203

DATED : November 25, 1986

INVENTOR(S) : R. Stirling Ferguson

It is certified that error appears in the above—identified patent and that said Letters Patent is hereby corrected as shown below:

Column 3, line 33, "except that" should read -- except in that --.

Column 4, line 68, "member 2" should read -- member 42 --.

Column 7, line 19, "culture" should read -- aperture --.

Column 7, line 33, "end" should be deleted.

Signed and Sealed this

Seventeenth Day of January, 1989

*Attest:*

DONALD J. QUIGG

*Attesting Officer*

*Commissioner of Patents and Trademarks*